US010947477B2

(12) United States Patent
Yoshinari et al.

(10) Patent No.: US 10,947,477 B2
(45) Date of Patent: Mar. 16, 2021

(54) GREASE COMPOSITION

(71) Applicant: KYODO YUSHI CO., LTD., Fujisawa (JP)

(72) Inventors: Terasu Yoshinari, Chigasaki (JP); Tomonobu Komoriya, Chigasaki (JP); Yuki Takeyama, Fujisawa (JP)

(73) Assignee: KYODO YUSHI CO., LTD., Fujisawa (JP)

( * ) Notice: Subject to any disclaimer, the term of this patent is extended or adjusted under 35 U.S.C. 154(b) by 0 days.

(21) Appl. No.: 16/078,992

(22) PCT Filed: Mar. 8, 2017

(86) PCT No.: PCT/JP2017/009208

§ 371 (c)(1),
(2) Date: Aug. 22, 2018

(87) PCT Pub. No.: WO2017/154972

PCT Pub. Date: Sep. 14, 2017

(65) Prior Publication Data

US 2019/0055491 A1 Feb. 21, 2019

(30) Foreign Application Priority Data

Mar. 8, 2016 (JP) ..... JP2016-044321

(51) Int. Cl.

| | |
|---|---|
| ***C10M 169/02*** | (2006.01) |
| ***C10M 105/18*** | (2006.01) |
| ***C10M 115/08*** | (2006.01) |
| ***C10M 169/06*** | (2006.01) |
| ***C10N 30/06*** | (2006.01) |
| ***C10N 50/10*** | (2006.01) |
| *C10N 30/08* | (2006.01) |
| *C10N 30/10* | (2006.01) |
| *C10N 40/02* | (2006.01) |

(52) U.S. Cl.

CPC ..... *C10M 169/02* (2013.01); *C10M 105/18* (2013.01); *C10M 115/08* (2013.01); *C10M 169/06* (2013.01); *C10M 2207/0406* (2013.01); *C10M 2207/281* (2013.01); *C10M 2215/064* (2013.01); *C10M 2215/1026* (2013.01); *C10N 2030/06* (2013.01); *C10N 2030/08* (2013.01); *C10N 2030/10* (2013.01); *C10N 2040/02* (2013.01); *C10N 2050/10* (2013.01)

(58) Field of Classification Search

CPC ..... C10M 169/02; C10M 2207/2805; C10M 2215/026; C10M 2215/1026; C10M 2207/2835; C10M 105/18; C10M 115/08; C10M 2207/0406; C10M 169/06; C10M 2207/281; C10M 2215/064; F16C 33/6633; C10N 2240/02; C10N 2220/022; C10N 2230/02; C10N 2230/68; C10N 2230/36; C10N 2250/10; C10N 2230/08; C10N 2230/06; C10N 2230/10; C10N 2030/06; C10N 2030/08; C10N 2030/10; C10N 2040/02; C10N 2050/10; C10N 2207/2835

See application file for complete search history.

(56) References Cited

U.S. PATENT DOCUMENTS

| | | | | |
|---|---|---|---|---|
| 5,728,659 | A * | 3/1998 | Naka | C10M 115/08 508/552 |
| 6,407,292 | B1 | 6/2002 | Wu et al. | |
| 10,487,034 | B2 * | 11/2019 | Hayashi | C07C 43/275 |
| 2012/0314985 | A1 * | 12/2012 | Saita | C10M 169/06 384/490 |
| 2013/0150607 | A1 | 6/2013 | Winsett | |
| 2015/0166447 | A1 * | 6/2015 | Hayashi | C10M 105/18 508/581 |
| 2015/0225327 | A1 * | 8/2015 | Hayashi | C10M 105/18 508/581 |
| 2015/0252282 | A1 * | 9/2015 | Yoshinari | B60K 31/185 508/552 |

FOREIGN PATENT DOCUMENTS

| | | | | |
|---|---|---|---|---|
| JP | S5073064 | A | 6/1975 | |
| JP | S5073065 | A | 6/1975 | |
| JP | S5573791 | A | 6/1980 | |
| JP | H06088085 | A | 3/1994 | |
| JP | 2007039628 | A | 2/2007 | |
| JP | 2012102051 | A | 5/2012 | |
| JP | 2013119549 | A | 6/2013 | |
| WO | 9700927 | A1 | 1/1997 | |
| WO | 0039061 | A1 | 7/2000 | |
| WO | 2005040081 | A1 | 5/2005 | |
| WO | 2014069669 | A1 | 5/2014 | |
| WO | 2014196599 | A1 | 12/2014 | |
| WO | WO-2014196599 | A1 * | 12/2014 | C10M 169/02 |

OTHER PUBLICATIONS

International Search Report (PCT/ISA/210) dated May 30, 2017, by the Japanese Patent Office as the International Searching Authority for International Application No. PCT/JP2017/009208.

(Continued)

*Primary Examiner* — Pamela H Weiss

(74) *Attorney, Agent, or Firm* — Buchanan, Ingersoll & Rooney PC

(57) ABSTRACT

Provided is a grease composition including a thickener and a base oil, in which the thickener is a urea compound represented by formula (1)

R1-NHCONH—R2-NHCONH—R3 (1)

wherein R2 represents a divalent $C_{6-15}$ aromatic hydrocarbon group, and R1 and R3 may be the same or different and each represent an $C_{8-22}$ alkyl group, a cyclohexyl group, or an $C_{6-12}$ aryl group, and as the base oil, one or more types of a compound represented by formula (2) are contained at 40% by mass or more relative to a total mass of the base oil, wherein R4 and R5 may be the same or different and each represent a linear or branched $C_{10-26}$ alkyl group, where m and n are real numbers being 0 or more which satisfy m+n=2.

7 Claims, No Drawings

(56) References Cited

OTHER PUBLICATIONS

Written Opinion (PCT/ISA/237) dated May 30, 2017, by the Japanese Patent Office as the International Searching Authority for International Application No. PCT/JP2017/009208.
Kawano, "Application Examples and Effects of Phenyl Ether-Based Synthetic Lubricants," Journal of Economic Maintenance Tribology, Lubrication Technology Inc., Dec. 5, 2000, vol. 417 (Dec. 2000 Issue), p. 18-23.

* cited by examiner

GREASE COMPOSITION

TECHNICAL FIELD

The present invention relates to a grease composition which is suitable for use in a rolling-element bearing, in particular a rolling-element bearing for an automotive part.

BACKGROUND ART

In response to the demands for reduction in size and weight and expansion of a cabin space of an automobile, it is required to reduce an engine room space. Under such circumstances, there is an attempt to reduce the sizes and the weights of electric and auxiliary parts such as alternators, electromagnetic clutches, and tension pulleys. In addition, the engine room is tightly closed for quietness, which raises the temperature of the use environment. Moreover, heat resistance is required not only for rolling-element bearings of electric and auxiliary parts, but also for those of some automotive parts such as EGR valves, fan clutches, electric turbochargers, and transmissions other than electric and auxiliary parts. A grease with a long lubrication life which is capable of withstanding high temperatures is required as a grease favorable for use in a rolling-element bearing, in particular a rolling-element bearing for an automotive part.

On the other hand, since automobiles are used in cold areas as well, it is required for the grease at the same time to have a good low-temperature fluidity.

Alkyl diphenyl ethers (ADEs) have conventionally been used as a base oil of a grease for a rolling-element bearing of an automotive electric and auxiliary part. Various compounds have been reported to date as ADEs which are excellent in heat resistance (Patent Literatures 1 to 6 and Non Patent Literature 1).

As described above, however, a grease composition used in automotive electric and auxiliary parts is required to achieve both a further improved lubrication life along with size reduction, weight reduction, and tight closing of these mechanical parts and a good low-temperature fluidity along with expansion of the use environment.

CITATION LIST

Patent Literatures

Patent Literature 1: Japanese Patent Application Publication No. Sho. 50-73064

Patent Literature 2: Japanese Patent Application Publication No. Sho. 50-73065

Patent Literature 3: Japanese Patent Application Publication No. Sho. 55-73791

Patent Literature 4: Japanese Patent Application Publication No. 2007-39628

Patent Literature 5: International Publication No. WO 2005/040081

Patent Literature 6: International Publication No. WO 2000/39061

Non Patent Literature

Non Patent Literature 1: KAWANO Masaji, "Application Examples and Effects of Phenyl Ether-Based Synthetic Lubricants," Journal of Economic Maintenance Tribology, Lubrication Technology Inc., Dec. 5, 2000, Volume 417 (December 2000 Issue), P. 18-23

SUMMARY OF INVENTION

Problem to be Solved by the Invention

The present invention aims to provide a grease composition which is excellent in lubrication life and low-temperature fluidity.

Means for Solution of the Problem

We have made earnest studies to achieve the object described above and found as a result that use of particular alkyl diphenyl ethers singly or as a mixture as a base oil makes it possible to obtain a grease composition which is excellent in lubrication life and low-temperature fluidity. This finding has led to the completion of the present invention.

To be more specific, the present invention provides a grease composition as follows:

1. A grease composition including a thickener and a base oil, in which the thickener is a urea compound represented by the following formula (1):

$$R^1\text{—NHCONH—}R^2\text{—NHCONH—}R^3 \quad (1)$$

wherein $R^2$ represents a divalent aromatic hydrocarbon group having 6 to 15 carbon atoms, and $R^1$ and $R^3$ may be the same or different and each represent an alkyl group having 8 to 22 carbon atoms, a cyclohexyl group, or an aryl group having 6 to 18 carbon atoms, and as the base oil, one or more members of a compound represented by the following formula (2) are contained at 40% by mass or more relative to a total mass of the base oil (2)

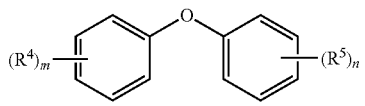

wherein $R^4$ and $R^5$ may be the same or different and each represent a linear or branched alkyl group having 10 to 26 carbon atoms, where m and n are real numbers being 0 or more which satisfy m+n=2.

2. The grease composition according to 1 described above, in which the thickener is one or more members from a urea compound represented by a formula (1-1), a urea compound represented by a formula (1-2), a urea compound represented by a formula (1-3), a urea compound represented by a formula (1-4), and a urea compound represented by a formula (1-5) below.

$$R^{10}\text{—NHCONH—}R^2\text{—NHCONH—}R^{10} \quad (1\text{-}1)$$

$$R^{10}\text{—NHCONH—}R^2\text{—NHCONH—}R^{30} \quad (1\text{-}2)$$

$$R^{30}\text{—NHCONH—}R^2\text{—NHCONH—}R^{30} \quad (1\text{-}3)$$

$$R^{10}\text{—NHCONH—}R^2\text{—NHCONH—}R^{40} \quad (1\text{-}4)$$

$$R^{40}\text{—NHCONH—}R^2\text{—NHCONH—}R^{40} \quad (1\text{-}5)$$

wherein $R^{10}$ represents a cyclohexyl group, $R^2$ represents a divalent aromatic hydrocarbon group having 6 to 15 carbon atoms, $R^{30}$ represents an alkyl group having 8 to 22 carbon atoms, and $R^{40}$ represents an aryl group having 6 to 18 carbon atoms.

3. The grease composition according to 2 described above, in which in the formula (1), (the number of moles of $R^{10}$)×100/(the number of moles of $R^{10}$+the number of moles of $R^{30}$) is 50% or more.

4. The grease composition according to any one of 1 to 3 described above, in which in the formula (2), $R^4$ and $R^5$ may be the same or different and are each a branched alkyl group having 10 to 26 carbon atoms.

5. The grease composition according to any one of 1 to 4 described above, in which in the formula (2), $R^4$ and $R^5$ may be the same or different and are each a linear or branched alkyl group having 12 to 14 carbon atoms.

6. The grease composition according to any one of claims 1 to 5, which is used for a rolling-element bearing.

Advantageous Effects of Invention

The present invention makes it possible to provide a grease composition which is excellent in lubrication life (in particular, bearing lubrication life under a high temperature) and low-temperature fluidity. The grease composition of the present invention is also excellent in heat resistance.

DESCRIPTION OF EMBODIMENTS

[Thickener]

The grease in a bearing under a high-temperature environment varies in fluidity depending on the type of the thickener, which contributes to the bearing lubrication life to a large extent. In order for a grease to have a long lubrication life, it is necessary that the grease do not soften or leak and continue to stay constantly at a lubricated region. The thickener used in the present invention is a diurea compound represented by the following formula (1):

$$R^1\text{—NHCONH—}R^2\text{—NHCONH—}R^3 \quad (1)$$

wherein $R^2$ represents a divalent aromatic hydrocarbon group having 6 to 15 carbon atoms, and $R^1$ and $R^3$ may be the same or different and each represent an alkyl group having 8 to 22 carbon atoms, a cyclohexyl group, or an aryl group having 6 to 12 carbon atoms.

Representative examples of $R^2$ include the ones represented by the following structural formulas. Among these, the group in the middle having a methylene group linked with two phenyl groups is most preferable.

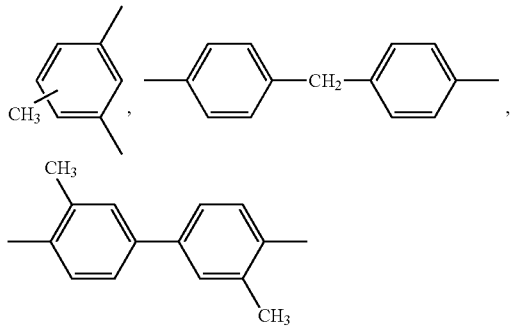

The thickener is preferably one or more members from the urea compound represented by formula (1-1), the urea compound represented by formula (1-2), the urea compound represented by formula (1-3), the urea compound represented by formula (1-4), and the urea compound represented by formula (1-5) below:

$$R^{10}\text{—NHCONH—}R^2\text{—NHCONH—}R^{10} \quad (1\text{-}1)$$

$$R^{10}\text{—NHCONH—}R^2\text{—NHCONH—}R^{30} \quad (1\text{-}2)$$

$$R^{30}\text{—NHCONH—}R^2\text{—NHCONH—}R^{30} \quad (1\text{-}3)$$

$$R^{10}\text{—NHCONH—}R^2\text{—NHCONH—}R^{40} \quad (1\text{-}4)$$

$$R^{40}\text{—NHCONH—}R^2\text{—NHCONH—}R^{40} \quad (1\text{-}5)$$

wherein $R^{10}$ represents a cyclohexyl group, $R^2$ represents a divalent aromatic hydrocarbon group having 6 to 15 carbon atoms, $R^{30}$ represents an alkyl group having 8 to 22 carbon atoms, and $R^{40}$ represents an aryl group having 6 to 18 carbon atoms.

It is preferable that (the number of moles of $R^{10}$)×100/(the number of moles of $R^{10}$+the number of moles of $R^{30}$) be 50% or more, more preferably 50 to 95%, further preferably 60 to 90%, and particularly preferably 70 to 90%.

As the alkyl group having 8 to 22 carbon atoms being $R^{30}$, a linear alkyl group having 8 to 18 carbon atoms is preferable. A linear alkyl group having 8 carbon atoms or a linear alkyl group having 18 carbon atoms is most preferable.

As the aryl group having 6 to 18 carbon atoms being $R^4$, an aromatic hydrocarbon group having 7 carbon atoms is preferable and a p-tolyl group is more preferable.

The thickener is preferably the urea compound represented by formula (1-3) described above, one or more types from the urea compound represented by formula (1-1), the urea compound represented by formula (1-2), and the urea compound represented by formula (1-3) described above, or one or more types from the urea compound represented by formula (1-1), the urea compound represented by formula (1-4), and the urea compound represented by formula (1-5) described above.

The thickener is particularly preferably a mixture of three types of the urea compound represented by formula (1-1), the urea compound represented by formula (1-2), and the urea compound represented by formula (1-3) described above. It is especially preferable that each $R^{30}$ in formulas (1-2) and (1-3) be a linear alkyl group having 18 carbon atoms.

Here, the percentage of the number of moles of the cyclohexyl group relative to the total number of moles of the alkyl group having 18 carbon atoms and the cyclohexyl group is preferably 50 to 95%, more preferably 60 to 90%, and particularly preferably 70 to 90%.

The most preferable diurea compound is a diurea compound synthesized from diphenylmethane diisocyanate, cyclohexylamine, and stearylamine (mixture of the three types of compounds represented by the following structural formulas). In particular, it is preferable that cyclohexylamine:stearylamine=5:1 (molar ratio).

(1-1-1)

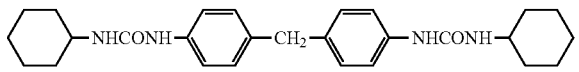

(1-2-1)

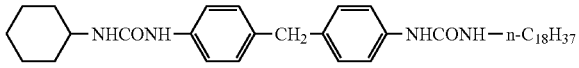

-continued (1-3-1)

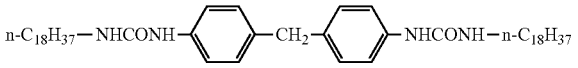

The content of the thickener is preferably 5 to 25% by mass and more preferably 10 to 20% by mass relative to the mass of the grease composition of the present invention. If the content of the thickener is less than 5% by mass, the grease may soften and leak, making it impossible to obtain a satisfactory lubrication life. On the other hand, if the content of the thickener is more than 25% by mass, it may become difficult for the grease to enter the lubricated region due to insufficient fluidity, making it impossible to obtain a satisfactory lubrication life.

[Base Oil]

The base oil used in the present invention contains one or more types of the compound represented by the formula (2) described above.

In the formula (2), $R^4$ and $R^5$ may be the same or different and each represent a linear or branched alkyl group having 10 to 26 carbon atoms, where m and n are real numbers being 0 or more which satisfy m+n=2.

$R^4$ and $R^5$ may be the same or different and are preferably a linear or branched alkyl group having 10 to 26 carbon atoms.

$R^4$ and $R^5$ may be the same or different and are most preferably a linear or branched alkyl group having 12 to 14 carbon atoms.

A monoalkyl adduct and/or a trialkyl adduct can be generated in the production process of the compound represented by the formula (2). For this reason, the base oil used in the present invention may contain the monoalkyl adduct and/or the trialkyl adduct in addition to the compound represented by the formula (2).

The base oil used in the present invention may also contain a base oil usually used as the base oil of a grease.

The base oils which can be used together include, for example, ester-based synthetic oils represented by ether-based synthetic oils, diesters, and polyolesters other than the formula (2); synthetic hydrocarbon oils represented by poly alpha olefins; silicone-based synthetic oils; and fluorine-based synthetic oils. Among these, the ether-based synthetic oils, the ester-based synthetic oils, and the synthetic hydrocarbon oil are preferable. The ester-based synthetic oil is preferably a complex ester oil synthesized from a polyvalent alcohol (for example, pentaerythritol), a monovalent fatty acid (for example, a linear or branched saturated or unsaturated fatty acid having 6 to 22 carbon atoms such as caprylic acid and nonanoic acid), and a polyprotic acid (for example, a linear or branched saturated or unsaturated diprotic acid having 3 to 10 carbon atoms such as adipic acid). A complex ester oil from adipic acid, heptanoic acid, caprylic acid, capric acid, and pentaerythritol is particularly preferable.

The compound represented by the formula (2) is preferably 40 to 100% by mass, more preferably 50 to 100% by mass, and particularly preferably 60 to 90% by mass relative to the total mass of the base oil of the grease composition of the present invention. If such an amount is contained, it is possible to obtain excellent lubrication life and low-temperature fluidity at the same time.

The base oil is preferably at least 50% by mass relative to the total mass of the grease composition of the present invention.

The kinematic viscosity of the base oil at 40° C. is preferably, but is not limited to, 30 to 300 $mm^2/s$, more preferably 40 to 200 $mm^2/s$, and particularly preferably 50 to 100 $mm^2/s$. If the kinematic viscosity of the base oil at 40° C. is higher than 300 $mm^2/s$, the low-temperature fluidity becomes unsatisfactory. If the kinematic viscosity of the base oil at 40° C. is lower than 30 $mm^2/s$, evaporation takes place, resulting in insufficient heat resistance, and such kinematic viscosity is not preferable.

[Additive]

The grease composition of the present invention may further contain an additive usually used in various types of lubricants and greases. Such an additive includes an anti-oxidant, a rust preventative, a load carrying additive, a metal corrosion inhibitor represented by benzotriazole, an oiliness improver represented by a fatty acid or a fatty acid ester, and a solid lubricant represented by molybdenum disulfide. Among these, it is preferable to contain the anti-oxidant, the rust preventative, or the load carrying additive. It is particularly preferable to contain the anti-oxidant.

The content of these optional additives is usually 0.2 to 25% by mass relative to the total mass of the grease composition of the present invention.

The anti-oxidant includes an amine-based anti-oxidant, a phenol-based anti-oxidant, and the like.

The amine-based anti-oxidant includes N-n-butyl-p-aminophenol, 4,4'-tetramethyl-di-aminodiphenylmethane, α-naphthylamine, N-phenyl-α-naphthyl amine, phenothiazine, an alkyl diphenylamine, and the like. Among these, the alkyl diphenylamine is preferable.

The phenol-based anti-oxidant includes 2,6-di-tertiary butyl-p-cresol (BHT), 2,2'-methylenebis(4-methyl-6-tertiary butylphenol), 4,4'-butylidenebis(3-methyl-6-tertiary butylphenol), 2,6-di-tertiary butyl-phenol, 2,4-dimethyl-6-tertiary butylphenol, tertiary butylhydroxyanisole (BHA), 4,4'-butylidenebis(3-methyl-6-tertiary butylphenol), 4,4'-methylenebis(2,3-di-tertiary butylphenol), 4,4'-thiobis(3-methyl-6-tertiary butylphenol), and octadecyl-3-(3,5-di-t-butyl-4-hydroxyphenyl)propionate, and the like. Among these, octadecyl-3-(3,5-di-t-butyl-4-hydroxyphenyl)propionate is preferable.

As the anti-oxidant, it is preferable to contain the amine-based anti-oxidant and the phenol-based anti-oxidant and particularly preferable to contain the alkyl diphenylamine and the octadecyl-3-(3,5-di-t-butyl-4-hydroxyphenyl)propionate.

The content of the anti-oxidant is preferably 0.5 to 6% by mass relative to the total mass of the grease composition of the present invention.

The rust preventative includes an inorganic rust preventative and an organic rust preventative. The inorganic rust preventative includes an inorganic metal salt such as Na silicate, Li carbonate, K carbonate, and Zn oxide. Zinc oxide is preferable. The organic rust preventative includes, for example, organic sulfonates such as zinc sulfonate and Ca sulfonate; benzoic acids such as Na benzoate and Li benzoate; carboxylates such as Na sebacate; succinic acid derivatives such as succinic acid, succinic anhydride, and succinic acid half esters; sorbitan esters such as sorbitan monooleate and sorbitan trioleate; and saturated or unsaturated fatty acids having 4 to 22 carbon atoms, preferably saturated or unsaturated fatty acids having 8 to 18 carbon atoms and saturated or unsaturated amines having 1 to 42 carbon atoms, and preferably fatty acid amine salts composed of a saturated or unsaturated amine having 4 to 22 carbon atoms. The succinic acid derivatives, the organic sulfonates, and the fatty acid amine salts are preferable, and the succinic acid half esters; the zinc sulfonates (in particular, zinc dinonylnaphthalene sulfonate); salts of a fatty acid having 8 carbon atoms and an amine having 12 carbon atoms; and a mixture containing a fatty acid having 18 carbon atoms and a (mixture) amine having 12 to 20 carbon atoms are particularly preferable.

The content of the rust preventative is preferably 0.2 to 10% by mass relative to the total mass of the grease composition of the present invention.

The load carrying additive includes zinc dialkyldithiocarbamate (ZnDTC) and dialkyldithiophosphate (ZnDTP).

The content of the load carrying additive is preferably 0.2 to 5% by mass relative to the total mass of the grease composition of the present invention.

[Worked Penetration]

The worked penetration of the grease composition of the present invention is preferably 200 to 310. If the worked penetration exceeds 310, leakage attributed to high-speed rotation may occur frequently, making it impossible to obtain a satisfactory lubrication life. On the other hand, if the worked penetration falls short of 200, the fluidity of the grease may become poor, making it impossible to obtain a satisfactory lubrication life.

[Bearing]

The bearing which seals the grease composition of the present invention is preferably a rolling-element bearing for an automotive part. The automotive part as an electric and auxiliary part includes an alternator, an electromagnetic clutch for an automotive air conditioner, an intermediate pulley, an idler pulley, a tension pulley, and the like. In addition, the automotive part other than an electric and auxiliary part includes an EGR valve, a fan clutch, an electric turbocharger, a transmission, and the like.

The composition of the present invention is particularly preferably composed essentially of a thickener, a base oil, and an additive, in which the thickener is composed of the compound represented by the formula (1), and the base oil is composed of a mixture of the compound represented by the formula (2) described above and an analog thereof (monoalkyl adduct and/or trialkyl adduct).

The composition of the present invention is further particularly preferably composed essentially of a thickener, a base oil, and an additive. The thickener is composed of a urea compound of the formula (1), where $R^2$ is a divalent aromatic hydrocarbon group having 6 to 15 carbon atoms, and $R^1$ and $R^3$ may be the same or different and are each an alkyl group having 8 to 22 carbon atoms or a cyclohexyl group. The base oil is composed of a mixture of the compound represented by the formula (2) described above and an analog thereof (monoalkyl adduct and/or trialkyl adduct).

The composition of the present invention is further particularly preferably composed essentially of a thickener, a base oil, and an additive. The thickener is composed of a urea compound of the formula (1), where $R^2$ is a divalent aromatic hydrocarbon group having 6 to 15 carbon atoms, and $R^1$ and $R^3$ may be the same or different and are each a cyclohexyl group or an aryl group having 6 to 12 carbon atoms. The base oil is composed of a mixture of the compound represented by the formula (2) described above and an analog thereof (monoalkyl adduct and/or trialkyl adduct).

EXAMPLES

<Test Grease>

Preparation of Test Grease

In the base oil, diphenylmethane diisocyanate (1 mole) was reacted with a predetermined amine (2 moles. Octylamine, stearylamine, cyclohexylamine, or p-toluidine) to produce a base grease, which was added with the base oil and the additive, followed by milling process so that the worked penetration was set to 300 (JIS K2220, 60-stroke worked penetration) to prepare a grease.

Table 1 below shows the content of the test grease. The components used to prepare the test grease are as follows.

Note that "mass %" in the table means % by mass relative to the total mass of the test grease. The number in the parentheses following "Balance" means the mass ratio of the base oil.

<Base Oil>

ADE 1 . . . ether oil (68.3 $mm^2/s$ at 40° C.) synthesized from diphenylether, 1-dodecene, and 1-tetradecene dialkyl adduct: 79.7% trialkyl adduct: 20.3%

ADE 2 . . . ether oil (15.8 $mm^2/s$ at 40° C.) synthesized from diphenylether, 1-dodecene, and 1-tetradecene monoalkyl adduct: 97.9% dialkyl adduct: 2.1%

ADE 3 . . . ether oil (103 $mm^2/s$ at 40° C.) synthesized from diphenylether, 1-dodecene, and 1-tetradecene monoalkyl adduct: 1.3% dialkyl adduct: 35.7% trialkyl adduct: 63.0%

Note that the percentages of the alkyl adducts in the present specification were obtained from a spectrum by gel permeation chromatograph (GPC column: PLgel, eluent: chloroform, detector: differential refractometer, sample concentration: 5%).

The kinematic viscosity of the base oil at 40° C. was measured in accordance with JIS K 2220 23.

<Thickener>

Alicyclic-Aliphatic Diurea A . . . a diurea compound synthesized from diphenylmethane diisocyanate, cyclohexylamine, and stearylamine (cyclohexylamine:stearylamine=5:1 (molar ratio))

Alicyclic-Aliphatic Diurea B . . . a diurea compound synthesized from diphenylmethane diisocyanate, cyclohexylamine, and stearylamine (cyclohexylamine:stearylamine=9.5:0.5 (molar ratio))

Alicyclic-Aliphatic Diurea C . . . a diurea compound synthesized from diphenylmethane diisocyanate, cyclohexylamine, and stearylamine (cyclohexylamine:stearylamine=6:4 (molar ratio))

<Additive>

Anti-Oxidant A: an amine-based anti-oxidant (alkyl diphenylamine)

Anti-Oxidant B: a phenol-based anti-oxidant (octadecyl-3-(3,5-di-t-butyl-4-hydroxyl phenyl)propionate)

<Test Method>

Bearing Lubrication Life Test

This test is a test on outer race rotation for evaluating the bearing lubrication life under a high temperature. The rolling-element bearing was driven under the following conditions. The lubrication life chosen was the shorter one of the time period until the motor produced an excess current and the time period until the bearing temperature increased by +15° C.

bearing type: 6203 test temperature: 180° C.

rotational speed: 15000 rpm test load: radial load 1000 N evaluation: ○; life time was 2000 hours or more ×; life time was less than 2000 hours Low-Temperature Torque Test (JIS K 2220 18.)

test temperature: −40° C.

evaluation: ○; low-temperature torque was less than 800

×; low-temperature torque was 800 or more

Table 1 and Table 2 show the results.

TABLE 1

| | | Ex. 1 | Ex. 2 | Ex. 3 | Ex. 4 |
|---|---|---|---|---|---|
| Thickener mass % | Alicyclic-Aliphatic Diurea A | 15 | — | — | 15 |
| | Alicyclic-Aliphatic Diurea B | — | 15 | — | — |
| | Alicyclic-Aliphatic Diurea C | — | — | 15 | — |
| Base Oil mass % | ADE 1 | Balance (100) | Balance (100) | Balance (100) | Balance (60) |
| | ADE 2 | — | — | — | — |
| | ADE 3 | — | — | — | Balance (40) |
| | Kinematic Viscosity at 40° C., $mm^2/s$ | 68.3 | 68.3 | 68.3 | 62.1 |
| | Percentage of Dialkyl Adduct, % | 79.7 | 79.7 | 79.7 | 62.1 |
| Additive mass % | Anti-Oxidant A | 1.5 | 1.5 | 1.5 | 1.5 |
| | Anti-Oxidant B | 1.2 | 1.2 | 1.2 | 1.2 |
| Bearing Lubrication Life Test (Outer Race Rotation) | Life Time h | 2660 | 2590 | 2420 | 3020 |
| | Evaluation | ○ | ○ | ○ | ○ |
| Low-Temperature Fluidity | Low-Temperature Torque mN · m | 460 | 470 | 440 | 560 |
| | Activation Evaluation | ○ | ○ | ○ | ○ |

TABLE 2

| | | Comparative Example 1 | Comparative Example 2 | Comparative Example 3 |
|---|---|---|---|---|
| Thickener mass % | Alicyclic-Aliphatic Diurea A | 15 | 15 | 15 |
| Base Oil mass % | ADE 1 | — | — | — |
| | ADE 2 | Balance (100) | Balance (15) | — |
| | ADE 3 | — | Balance (85) | Balance (100) |
| | Kinematic Viscosity at 40° C., $mm^2/s$ | 15.8 | 76.3 | 103 |
| | Percentage of Dialkyl Adduct, % | 2.1 | 30.7 | 35.7 |
| Additive mass % | Anti-Oxidant A | 1.5 | 1.5 | 1.5 |
| | Anti-Oxidant B | 1.2 | 1.2 | 1.2 |
| Bearing Lubrication Life Test (Outer Race Rotation) | Life Time h | 480 | 1720 | 3190 |
| | Evaluation | x | x | ○ |
| Low-Temperature Fluidity | Low-Temperature Torque mN · m | 100 | 710 | 1010 |
| | Activation Evaluation | ○ | ○ | x |

What is claimed is:

1. A grease composition comprising a thickener, a base oil, and antioxidant, wherein the thickener is a mixture of one of a urea compound represented by a formula (1-1), one of a urea compound represented by a formula (1-2), and one of a urea compound represented by a formula (1-3):

$$R^{10}—NHCONH—R^{2}—NHCONH—R^{10} \quad (1\text{-}1)$$

$$R^{10}—NHCONH—R^{2}—NHCONH—R^{30} \quad (1\text{-}2)$$

$$R^{30}—NHCONH—R^{2}—NHCONH—R^{30} \quad (1\text{-}3)$$

wherein $R^{10}$ represents a cyclohexyl group, $R^2$ represents a divalent aromatic hydrocarbon group having 6 to 15 carbon atoms, and $R^{30}$ represents an alkyl group having 8 to 22 carbon atoms and wherein (the number of moles of $R^{10}$)×100/(the number of moles of $R^{10}$+the number of moles of $R^{30}$) is 50% or more, and the base oil comprises a dialkyl ether and a monoalkyl ether or a dialkyl ether and a trialkyl ether, the dialkyl ether being represented by the following formula (2):

(2)

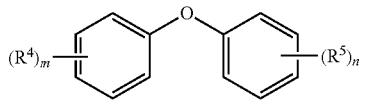

wherein $R^4$ and $R^5$ may be the same or different and each represent a linear or branched alkyl group having 10 to 26 carbon atoms, where m and n are real numbers being 0 or more which satisfy m+n=2, the monoalkyl ether being represented by the formula (2) wherein $R^4$ and $R^5$ are the same as $R^4$ and $R^5$ defined above, where m and n are real numbers being 0 or more which satisfy m+n=1 and the trialkyl ether being represented by the formula (2) wherein $R^4$ and $R^5$ are the same as $R^4$ and $R^5$ as defined above, where m and n are real numbers being 0 or more which satisfy m+n=3, wherein the compounds of formula (2) are present in an amount of 40% by mass or more based on the mass of the base oil wherein the base oil does not comprise a mixture of all three of the monoalkyl ether, the dialkyl ether, and the trialkyl ether, and wherein the base oil has a kinematic viscosity of the base oil at 40° C. of 30 to 100 $mm^2/s$.

2. The grease composition according to claim 1, wherein in the formula (2), $R^4$ and $R^5$ may be the same or different and are each a linear or branched alkyl group having 12 to 14 carbon atoms.

3. The grease composition according to claim 1, wherein the antioxidant is a combination of an amine antioxidant and a phenol antioxidant.

4. The grease composition according to claim 1, wherein the antioxidant is a combination of alkyl diphenylamine and octadecyl-3-(3,5-di-t-butyl-4-hydroxyphenyl) propionate.

5. The grease composition according to claim 1, wherein the antioxidant is contained in an amount of 0.5 to 6% by mass relative to the total mass of the grease composition.

6. The grease composition according to claim 1, wherein the thickener is contained in an amount of 5 to 25% by mass relative to the mass of the grease composition.

7. The grease composition according to claim 1, wherein the base oil is contained in an amount of 50% by mass or more relative to the total mass of the grease composition.

* * * * *